United States Patent [19]

Clifford et al.

[11] Patent Number: 4,684,322

[45] Date of Patent: Aug. 4, 1987

[54] COOLED TURBINE BLADE

[75] Inventors: Rodney J. Clifford, Gloucestershire; Ian J. Charters, Bristol, both of England

[73] Assignee: Rolls-Royce plc, England

[21] Appl. No.: 445,072

[22] Filed: Oct. 26, 1982

[30] Foreign Application Priority Data

Oct. 31, 1981 [GB] United Kingdom ..... 8132879

[51] Int. Cl.[4] ..... B63H 1/14

[52] U.S. Cl. ..... 416/95; 416/92; 416/96 A; 416/96 R; 416/97 R; 415/175

[58] Field of Search ..... 416/92, 95, 96 A, 96 R, 416/97; 415/175

[56] References Cited

U.S. PATENT DOCUMENTS

| | | | |
|---|---|---|---|
| 3,533,712 | 10/1970 | Kercher | 416/97 |
| 3,834,831 | 10/1974 | Mitchell | 416/95 |
| 3,844,679 | 10/1974 | Grondahl et al. | 416/95 |
| 4,118,145 | 10/1978 | Stahl | 416/96 R |

FOREIGN PATENT DOCUMENTS

| | | | |
|---|---|---|---|
| 853534 | 8/1952 | Fed. Rep. of Germany | 416/96 R |
| 165703 | 12/1981 | Japan | 416/96 R |
| 290667 | 11/1950 | Switzerland | 416/95 |
| 679931 | 9/1952 | United Kingdom . | |
| 728834 | 4/1955 | United Kingdom . | |
| 910400 | 11/1962 | United Kingdom . | |
| 1257041 | 12/1971 | United Kingdom . | |
| 1410014 | 10/1975 | United Kingdom . | |
| 1464389 | 2/1977 | United Kingdom . | |
| 1470322 | 4/1977 | United Kingdom . | |
| 1548154 | 7/1979 | United Kingdom . | |
| 2117455 | 10/1983 | United Kingdom | 416/95 |
| 779590 | 11/1980 | U.S.S.R. | 416/97 R |

*Primary Examiner*—Donald P. Walsh

*Attorney, Agent, or Firm*—Parkhurst & Oliff

[57] ABSTRACT

The blade has an aerofoil body 10 having a leading edge surface 11 which is cooled by air passing through a helical first passage 12 having first portions passing close to said leading edge surface and alternating with second portions passing through a more nearly central part of the blade section remote from said leading edge. A spanwise but straight second passage 15 extends through the blade in a position within the helical passage and closer to the second than the first portions thereof. Heat abstracted from the leading edge by air flow in said first portions is transferred by the flow to the second portions and from there through the blade material to the flow in the straight passage.

10 Claims, 5 Drawing Figures

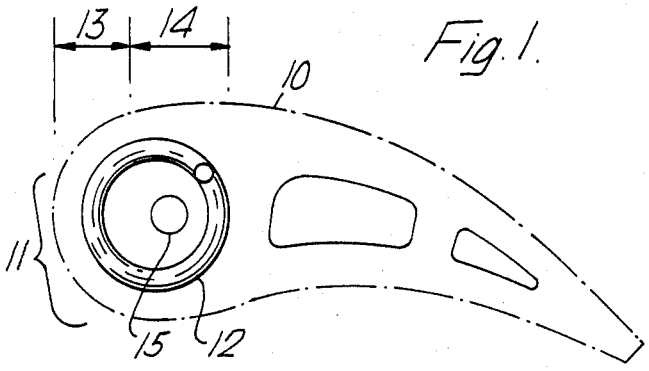
Fig. 1.
Fig. 2.
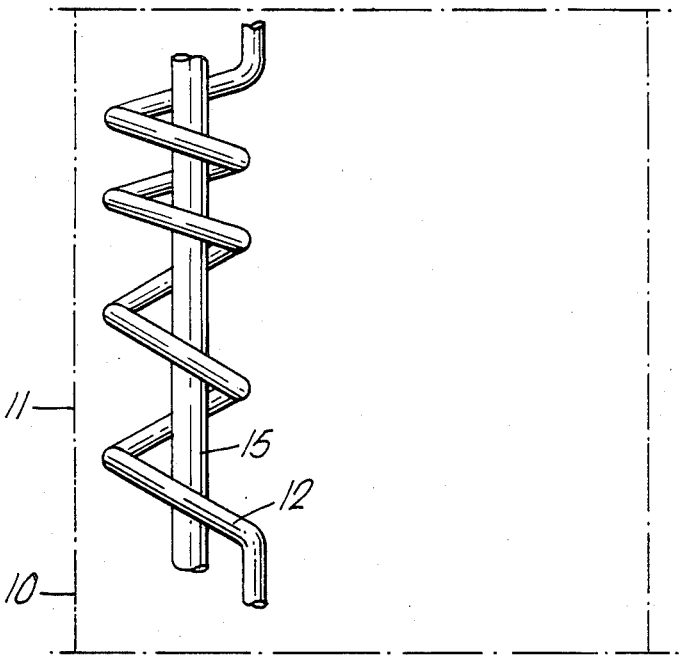

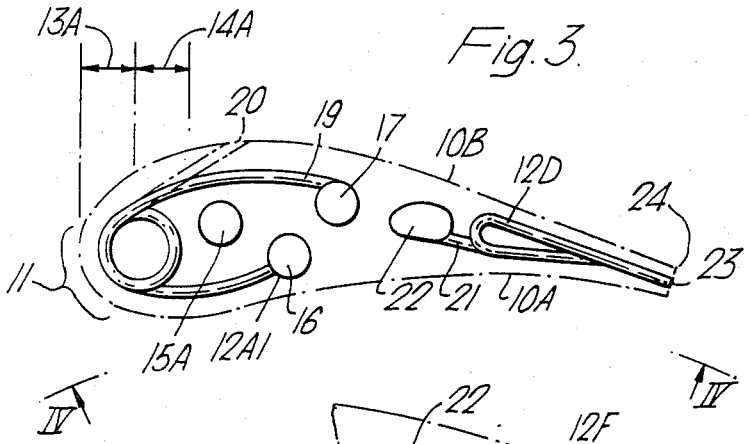
Fig. 3.
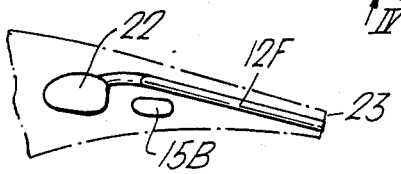
Fig. 5.
Fig. 4.
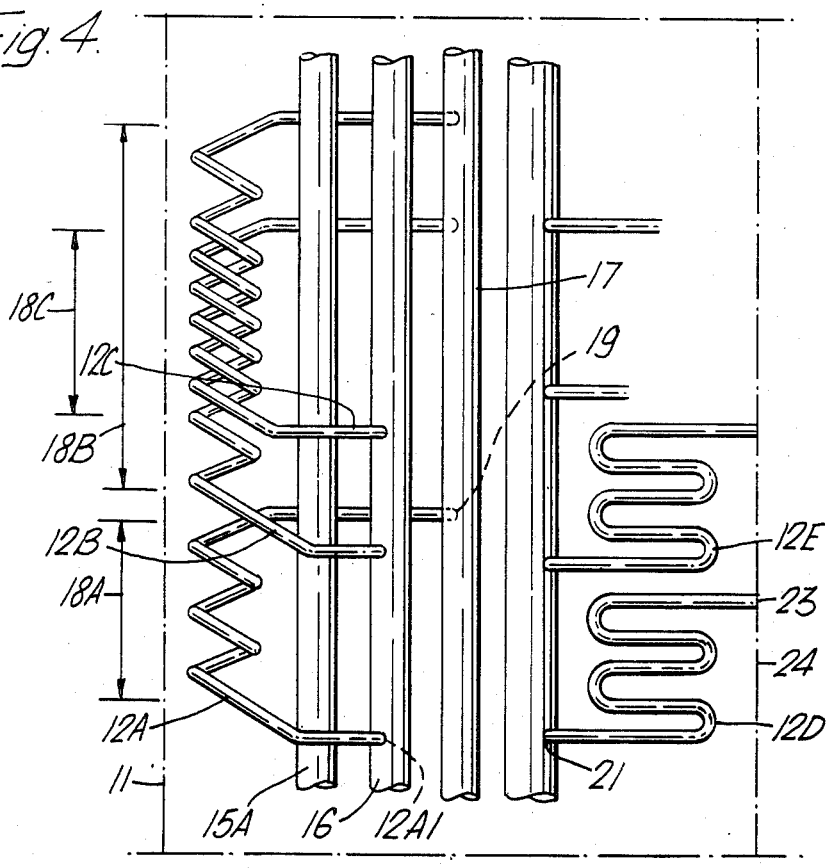

COOLED TURBINE BLADE

This invention relates to cooled turbine blades.

According to this invention, there is provided a turbine blade comprising an aerofoil body, a cooling air passage extending through the body in a helical or serpetine path such that the passage passes alternately between a first and a second region of the blade, wherein the second region is one which, during operation tends to have a general temperature lower than that of the first region, and the passage and second region are so arranged that during operation the cooling air in the passage becomes heated by the first region to a temperature greater than that of the second region, so that the second region receives heat from the cooling air.

The helical or serpetine configuration of the passage makes it possible for the passage to have a high length/-cross-section ratio. At the same time, if the length of the passage is required to be limited, two or more said passages may be provided in succession along the span of the blade. However, in a region requiring high heat transfer, two passages may be provided side by side or in overlapping or intertwining relationship. It will be seen that due to the helical or serpentine configuration of a said passage, the air flowing therethrough gives up heat at each pass through a said second region so that the heat transfer capacity of the air is at least partially replenished with each such pass. Thus the invention makes it possible to transfer heat rapidly from a hot to a cooler region of the blade over the whole span thereof.

The term "blade" used herein means a blade of a turbine rotor or a blade or vane of a turbine stator.

Examples of a blade according to this invention will now be described with reference to the accompanying drawings wherein:

FIG. 1 is a chordal view of a blade showing the cores of ducts and passages through the blade.

FIG. 2 is an elevation of the blade shown in FIG. 1.

FIG. 3 is a view similar to FIG. 1 but shows a modification.

FIG. 4 is a section on the line IV—IV in FIG. 3.

FIG. 5 is a detail of FIG. 3 showing a further modification.

Referring to FIGS. 1 and 2, the blade comprises an aerofoil body 10 having a leading edge surface 11 requiring to be cooled. The body 10 includes a cooling air passage 12 which extends generally in the direction of the span of the blade but follows a helical path such that the passage 12 passes alternately between a first region 13 lying close to the surface 11 and a second relatively cooler or heat sink region 14 lying remote from the surface 11. The relatively lower general temperature of the region 14 is produced or enhanced by a heat sink duct 15 extending spanwisely within the helical configuration of the passage 12 but closer to the region 14 than the region 13.

In operation cooling air is supplied to the passage 12 and to the duct 15. The air passing through the passage 12 receives heat at the region 13 and gives off at least some of that heat at the region 14, the latter region being cooled by the air flowing through the duct 15 and therefore, constituting a heat sink.

In the modification shown in FIGS. 3 and 4 a first passage 12A extends generally in the direction of the span of the blade but follows a helical path between a first region 13A lying close to the surface 11 and a second region 14A lying remote from the surface 11. The passage 12A has an inlet port 12A1 in a duct 16 extending spanwisely through the body 10 and fed with cooling air for the passage 12A. The passage 12A extends only over a region 18A being a part-length of the span of the blade and has an outlet port 19 in a duct 17 or an outlet port 20 at a surface portion of the blade remote from the surface 11. A heat sink duct 15A may also be provided.

Further passages 12B, 12C, similar to the passage 12A, are provided at regions 18B, 18C. Thc regions 18A, 18B, 18C lie generally in succession along the span of the blade but they may overlap, as shown between the regions 18B, 18C, where increased cooling effect is required, i.e. at relatively hotter portions of the surface 11.

At the trailing edge of the blade shown in FIGS. 3, 4, passages 12D, 12E are arranged in spanwise succession, each passage extending generally spanwisely but in serpentine configuration from an inlet port 21 in a supply duct 22 to an outlet port 23 at the trailing edge extremity 24 of the blade. Successive passes of the serpentine of each passage 12D, 12E may lie alternately adjacent the opposite sides lOA, lOB, of the blade so as to transfer heat from the hotter side lOA to the cooler side lOB. Alternatively, FIG. 5, a heat sink duct 15B may be provided to establish a region which is cool compared to the region more nearly adjacent the extremity 23 and where the air flowing through the serpentine passage, here denoted 12F, can be cooled.

We claim:

1. A turbine blade comprising an aerofoil body, at least one cooling air passage extending through the body in a helical path such that the passage passes alternately between a first and a second region of the blade, wherein the second region is one which, during operation, tends to have a general temperature lower than that of the first region and wherein the passage and the second region are so arranged that during operation the cooling air in the passage becomes heated by the first region to a temperature greater than that of the second region, so that the second region receives heat from the cooling air.

2. A blade according to claim 1 comprising a spanwise duct for cooling air to cool said second region.

3. A blade according to claim 2 wherein said duct extends within the helix defined by said passage.

4. A blade according to claim 2 wherein said duct extends outside the helix defined by said passage.

5. A blade according to claim 1 comprising a spanwise duct for cooling air, at least two said passages arranged in succession along the span of the blade, each passage having an inlet port in said duct.

6. A blade according to claim 1 wherein said first and second regions are adjacent to respective surfaces of the blade which, in operation, have different temperatures.

7. A turbine blade comprising an aerofoil body, at least one cooling air passage extending through the body in a serpentine path such that the passage passes alternately between a first and a second region of the blade, wherein the second region is one which, during operation, tends to have a general temperature lower than that of the first region and wherein the passage and the second region are so arranged that during operation the cooling air in the passage becomes heated by the first region to a temperature greater than that of the second region, so that the second region receives heat from the cooling air.

8. A blade according to claim 7 comprising a spanwise duct for cooling air to cool said second region.

9. A blade according to claim 7 comprising a spanwise duct for cooling air, at least two said passages arranged in succession along the span of the blade, each passage having an inlet port in said duct.

10. A blade according to claim 7 wherein said first and second regions are adjacent to respective surfaces of the blade which, in operation, have different temperatures.

* * * * *